US012791203B2

(12) United States Patent
Jenne et al.

(10) Patent No.: US 12,791,203 B2
(45) Date of Patent: Nov. 10, 2026

(54) EXPANSION TANK WITH ACTIVE FLOW MANIFOLD HEAD

(71) Applicant: Taco, Inc., Cranston, RI (US)

(72) Inventors: Justin Jenne, Rochester, MA (US); Edward Dion, Jr., Dartmouth, MA (US); Jaider Obregon, Pawtucket, RI (US); Ronnie Falcon, Fall River, MA (US)

(73) Assignee: TACO, LLC, Cranston, RI (US)

( * ) Notice: Subject to any disclaimer, the term of this patent is extended or adjusted under 35 U.S.C. 154(b) by 362 days.

(21) Appl. No.: 18/102,652

(22) Filed: Jan. 27, 2023

(65) Prior Publication Data

US 2023/0243520 A1 Aug. 3, 2023

Related U.S. Application Data

(60) Provisional application No. 63/304,558, filed on Jan. 28, 2022.

(51) Int. Cl.
*F24D 17/00* (2022.01)
*E03B 11/04* (2006.01)

(52) U.S. Cl.
CPC ..... *F24D 17/0073* (2013.01); *E03B 11/04* (2013.01); *F24D 17/0078* (2013.01)

(58) Field of Classification Search
CPC ..... F24D 17/0073; F24D 17/0078; F24D 17/0026; F24D 3/1016; E03B 11/04;
(Continued)

(56) References Cited

U.S. PATENT DOCUMENTS 2,123,809 A * 7/1938 Seitz ..... F24H 9/133 126/362.1
2,327,335 A * 8/1943 Boerner ..... B01F 25/316 261/76

(Continued)

FOREIGN PATENT DOCUMENTS

DE 19529959 A1 2/1997
DE 19818281 A1 7/1999
EP 0733863 A2 9/1996

OTHER PUBLICATIONS

Machine translation of DE 19529959A1 (Reflex Winkelmann & Pannhoff Gmbh & Co; Feb. 20, 1997), obtained Mar. 18, 2026 (Year: 1997).*

(Continued)

*Primary Examiner* — Craig M Schneider
*Assistant Examiner* — Andrew J Rost
(74) *Attorney, Agent, or Firm* — Loeb & Loeb LLP

(57) ABSTRACT

A manifoldhead and expansion tank combination is provided. The manifoldhead comprises an outer housing having an inlet channel and an opposed outlet channel extending laterally from the manifoldhead and a connection means, surrounding a third opening from the outer housing, for sealably connecting the manifoldhead to the to the expansion tank. The manifoldhead further includes, secured internally within the outer housing, a baffle plate extending longitudinally within the manifoldhead and having an opening extending through the baffle plate, the opening being preferably aligned with the inlet and outlet channels. The baffle plate extending into AND through the third opening to continue to separate the flow moving through the entire expansion tank into inlet and outlet flows, entering and leaving the third opening. There is also preferably provided another set of baffles extending across the third opening limiting the inlet and outlet flows through the expansion
(Continued)

tank. There are also provided recirculation systems for potable water that include a manifoldheaded expansion tank for providing both cool and heated potable water to a building where people live or work.

20 Claims, 6 Drawing Sheets

(58) Field of Classification Search
CPC ..... F15D 1/0005; F16L 55/00; Y10T 137/86372; Y10T 137/87265
USPC ..... 137/590, 592, 593
See application file for complete search history.

(56) References Cited

U.S. PATENT DOCUMENTS 3,857,413 A * 12/1974 Zahid ..... F16L 55/053 138/30
3,868,972 A * 3/1975 Zirps ..... F15B 1/18 138/30
4,069,844 A * 1/1978 Zahid ..... F16L 55/052 138/30
4,178,965 A * 12/1979 Zahid ..... F16L 55/053 138/30
4,248,269 A * 2/1981 Mercier ..... F16L 55/053 138/30
4,298,030 A * 11/1981 Mercier ..... F16L 55/053 138/30
6,343,622 B1 * 2/2002 Keijzer ..... F24D 3/1041 138/30
6,607,007 B1 * 8/2003 Hull ..... F16K 1/306 251/83
11,280,519 B2 * 3/2022 Hutchison ..... F24H 9/0015
2012/0097746 A1 4/2012 Haws
2019/0249592 A1 8/2019 Grava et al.

OTHER PUBLICATIONS

Extended European Search Report for EP 23747673.4 dated Dec. 10, 2025, 9 pages.

* cited by examiner

EXPANSION TANK WITH ACTIVE FLOW MANIFOLD HEAD

This invention relates to an improved system for the successful operation of expansion tanks, especially in the field of expansion tanks useful for water heating systems for residential, Commercial & Industrial buildings applications and efforts to reduce *legionella* risk in the water systems.

BACKGROUND

Expansion tanks have been found to be useful in many situations. With respect to water systems for any of residential, commercial and industrial uses, a problem often met is the accumulation of undesirable substances, such as sediments in tanks for storing domestic water from wells or the growth of disease causing bacterial in water from wells or in domestic hot water systems, especially, the risk of bacteria growth such as *legionella*, that pose a definite health risk.

Prior attempts to minimize or eliminate this problem have involved one of two areas of attack: First is the application of anti-bacterial materials dissolved in the water, often accomplished by providing a material on the inner surface of the rubber bladder in the expansion tank, such as an ionizable silver compound. Second, recognizing that volumes of static flow within the tank, especially at the bottom, allows particles to accumulate, whether inert materials such as sand or rust in the system, or colonies of bacteria.

From a water system design standpoint, reduction of areas of inactive flow are critical in reducing this risk. Traditional expansion tanks are installed with a length of pipe in which only the expanding and contracting fluid moves in this region, making it a "low flow" area at risk for bacteria growth. Other designs on the market are available that eliminate this "low flow" connection, by passing the entire flow of water through the tank. This type of design has some serious limitations and risks. One is that the entire flow going through the tank can increase the risk of the rubber expansion bladder eroding under the water flow. Two is if the connections are on opposite ends of the tank (typically top and bottom) that can cause further installation issues with changing piping in the field. Three is for field upgrades, if there are any issues with a with a previously installed "traditional design" it can't be converted to an "active flow" type design of this invention without also changing the expansion tank, possibly requiring major reordering of the entire flow system.

SUMMARY OF THE INVENTION

This invention incorporates a manifolded head for an expansion tank, providing both the inlet and outlet from one end of the tank, that is the entire flow into and out from the expansion tank. the tank preferably having interiorly a flexible bladder. The manifolded head, internally, comprises a baffle plate between the inlet and outlet, with one or more openings through the baffle plate sized to allow only a specific proportion of the total inlet flow to pass from the inlet into the manifolded head and directly to the outlet, without entering the tank. This allows for achieving a specific ratio of total outlet flow to tank flow to optimize flow into and through the interior of the tank. This limitation will improve the operation of the invention by avoiding at least some of the earlier problems with erosion of the interior surface of the tank. This is especially important where a bladder covers the entire tank surface when the water passes through. This will cause undesirable repair problems resulting from excessively high flow through the tank.

However, by properly using only the necessary amount of flow through the tank sufficient to prevent unnecessary erosion while preventing the accumulation of solid deposits and the growth of dangerous bacteria, such as the species causing Legionnaire's Disease.

The relative size of the baffle plate opening, relative to the size of the inlet to and outlet from the manifolded head, determines the flow into and through the tank back to the manifold head outlet, which must be great enough to provide the necessary flow throughout the tank, so as to avoid any stagnant flow spots, but not too great to result in an unnecessarily high abrasion, or erosion, rate of the flexible expansion bladder preferably covering the entire internal tank surface.

The remaining part of the inlet flow not passing through the baffle opening, directly to the manifold head outlet, is preferably passed from the manifold inlet, into and through a pipe extending longitudinally through the tank to near its opposite end, to insure sufficient flow throughout the full length of the tank. Sufficient flow means enough flow to carry out from the tank particulate solids that may otherwise attach to the internal surface of the bladder, and allow the growth of dangerous bacteria. More preferably, there are several smaller openings along the lower portion of the pipe to ensure flow is passed along the full width of the tank from the bottom up to the outlet.

This invention may be used for improving any system that provides potable water, whether hot or cold, that is intended to come into contact with people; for example, in hot water provided for showers or to a sink, or cooler water provided to sinks or drinking fountains for people. Other systems in which it could be useful, by way of example only, involve maintaining a desired humidity in a building interior, by exposing water to ambient air in a building for maintaining the desired humidity. Another example, includes the spray systems in outdoor playgrounds to cool children during the Summer, during hot weather.

BRIEF DESCRIPTION OF THE DRAWINGS

The drawing Figures depict preferred embodiments of the invention.

DETAILED DESCRIPTION OF THE INVENTION

Hereinafter, embodiments of the invention will be described in detail with reference to the accompanying drawings, and the details necessary for those skilled in the art to understand the contents of the invention will be described in detail. However, the invention may be embodied in many different forms within the scope of the appended claims, so the embodiments described below are provided merely as examples.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Figure 2:
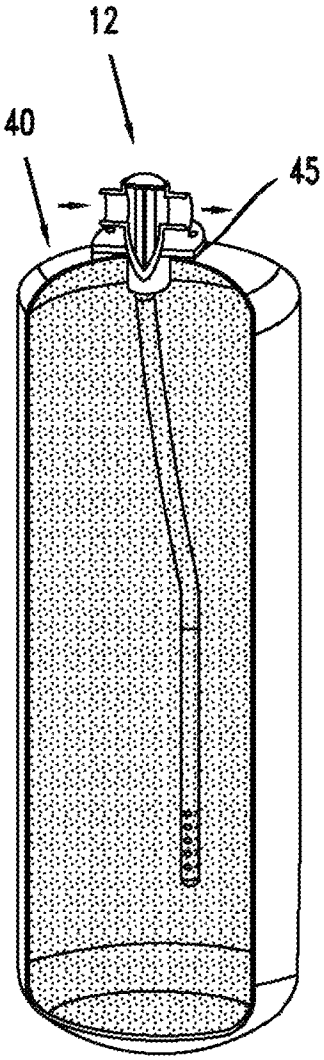
FIGS. 1 and 2, depict the full-length tank 40, in sectioned views, without and with the liquid flow respectively.
Figure 1:
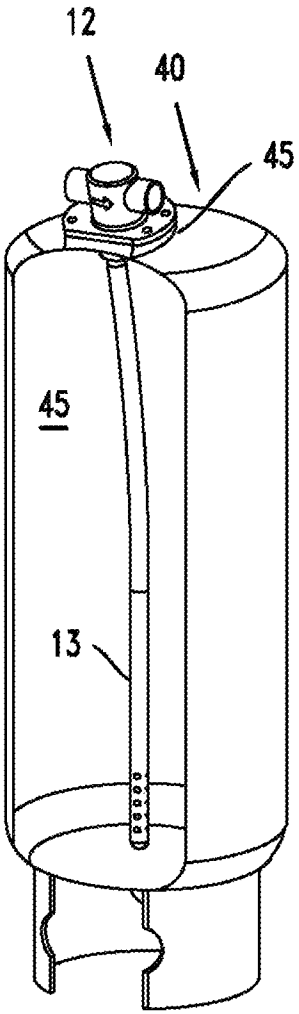

Referring to the drawings, FIGS. 1 and 2 show the major portions of the manifolded head and tank, including the baffle plate in the manifold head 12 and the flow pipe 13 from the inlet side of the baffle plate almost to the bottom of the tank interior 45. The openings at the bottom of the flow pipe 13 carry the portion of the inlet water not passing through the baffle plate, and passing through the tank 40 to insure that the water flows through the entire tank to exit from the outlet side of the baffle plate. The round dots shown in FIG. 2 are intended to depict the solids suspended in the flowing water which will be passed out from the entire tank with the flowing water through the manifold outlet. A downstream filter system can be used to remove the solids if desired, before reaching the user.

Figure 3:
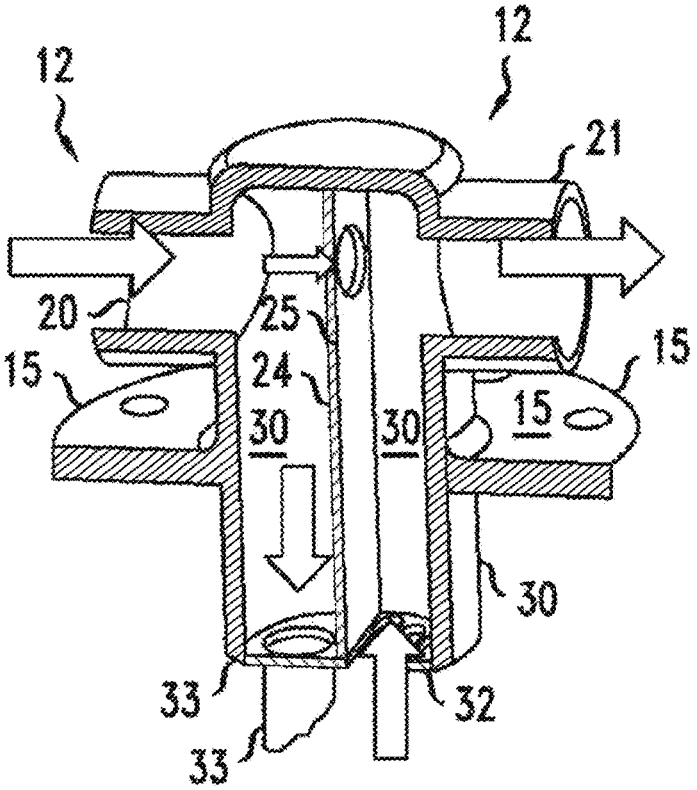
FIGS. 3 and 4 depict magnified, sectioned views of the inlet manifold 12, without and with the liquid flow.
Figure 4:
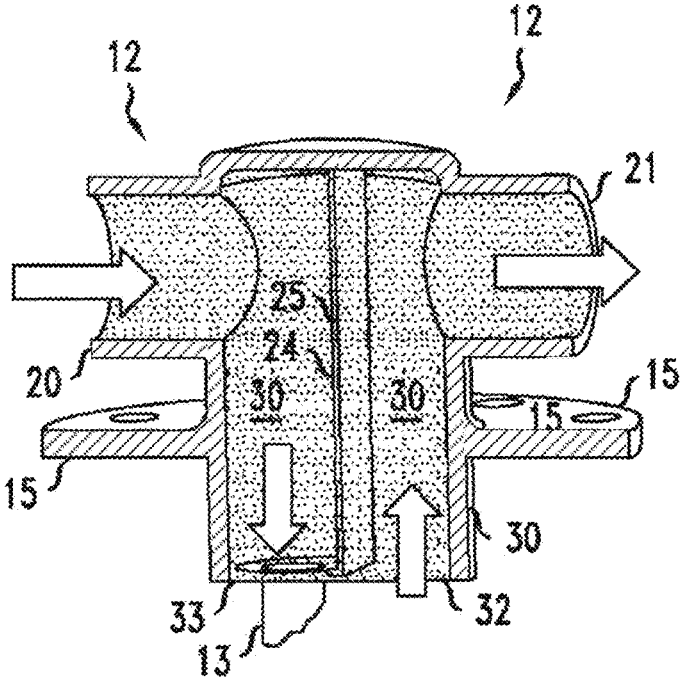
Figure 5:
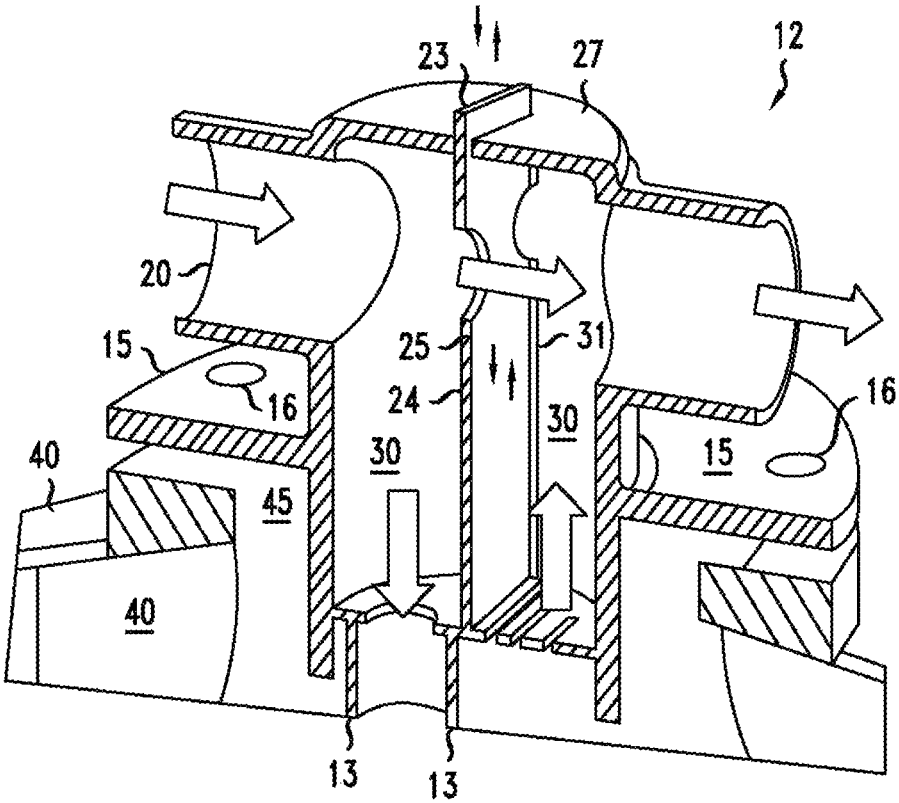
FIG. 5 depicts a further magnified, sectioned view of the tank manifold 12.

FIGS. 3 and 4 depict cut-0away interior view of the manifold head, with and without water flowing therethrough. The baffle plate 25 extends along and across the entire manifold head interior, blocking off a portion of the FIG. 5 shows, by different sized (width) arrows, the different "precise" liquid flows where the manifold head 12 is attached by a flange 15, to a matching flange on the upper, or end, section of an expansion tank with an internal bladder 45, the open end of the bladder 45 acting as a sealing washer between the two flanges. As is seen in FIGS. 1 and 2, when the tank is substantially filled with liquid, the flexible bladder 45 is forced up against the inner surface of the tank 40. The tank is usually formed of a metal, but may in some cases may be formed of a reinforced rigid polymeric plastic. The bladder is preferably formed of a strong rubbery material, generally butyl rubber is used today.

Referring to the drawings, FIG. 1 shows by a sectioned view the expansion tank's interior pipe 13, extending from the inlet side of the manifolded head 12 to the opposite end of the tank 40. A plurality of openings 17 through the wall of the opposite end of pipe 13 are depicted which provide for the passage of the "precise tank flow" portion of the "full flow inlet" liquid, which does not pass directly to the manifold head outlet, i.e., the "precise by-pass flow", that does pass through the opening 25 in the baffle 24, as shown in FIGS. 3-5. FIG. 2, is a stylized depiction of the several liquid flows of the liquid from the passing throughout the tank, including where the "Precise tank flow: and the "Precise by-pass flow" meet and combine in the manifolded head outlet portion 21, to form the "Full flow outlet".

FIGS. 3 and 4 depict magnified, sectioned views of the manifold head 12, without and with the stylized liquid flow, respectively. The baffle plate 24, with the precisely sized opening 25 therethrough, limits the flow from the inlet that can directly pass to the outlet 21, thus causing a portion of the flow from the inlet 20 to pass into and through the longitudinal pipe 13 to carry a portion of the full inlet 20 flow through the tank and back to the outlet side of the manifold head 12, upstream of the baffle plate opening(s) 25, so that the Full flow exits through the outlet 21 from the manifold head 12.

As shown, most existing expansion tanks have a single opening at one end of the expansion tank. Thus, this system allows for relatively easy substitution of the novel manifold head 12 of the present invention onto pre-existing expansion tanks, without disturbing any other parts of the overall fluid system. Alternatively, for use with tanks having a single, internally threaded opening, the connecting flange 15 can be omitted and the lower external surface of the shank 30 of the manifold 12 can be formed with a complementary external thread to match the internal thread of the expansion tank.

Referring to FIG. 5, this shows, by different sized (width) arrows, the different "precise" liquid flows where the manifold head 12 is attached by a flange 15, to a matching flange on the upper, or end, section of an expansion tank with an internal bladder 45, the open end of the bladder 45 acting as a sealing washer between the two flanges. As is seen in FIG. 2, when the tank is substantially filled with liquid, the flexible bladder 45 is forced up against the inner surface of the tank 40. The tank is usually formed of a metal, but may in some cases be formed of a reinforced rigid polymeric plastic. The bladder is preferably formed of a strong rubbery material, generally butyl rubber is used today.

In preferred embodiments, the by-pass flow along the internal surface of the bladder 45 in the expansion tank can be set to provide the necessary amount of flow to avoid any accumulation of sediment in the tank, as well as most importantly, prevent the growth of dangerous bacteria in any static flow portions of the tank. Such by-pass flow could be sufficient in a suitable case to provide sufficient movement of the liquid in the tank to prevent bacterial growth while greatly reducing potential abrasion of the rubber bladder 45 by reducing the flow by the baffle plate creating a partial by-pass through the tank 40, 45.

The round dots shown in FIGS. 2 and 4, are an attempt to depict the solid material that is stirred p and carried off from the tank by the flowing water, before the bacteria have an opportunity to multiply and become contagious to humans. The flow rate required for keeping the tank clear depends upon variables such as the size of the expansion tank, and the exact nature of the solids being brought in from the water source, e.g., underground well water tends to have more solids than surface reservoir sources. In many cases, even so-called laminar flow can be sufficient flow to carry away bacteria from the expansion tank and most small inert solids.

In order to allow for the varying total flow in a multi-use building, based upon usage by each resident of the building, the total open area size of the opening(s) 25 through the baffle plate 24, can be varied. In the simplest situation the baffle plate can be sealably removably held within the manifold head 12. As shown in FIG. 5, the central portion 27, of the manifold head 12, can be removable, thus allowing for the removal of the lower horizontal plate 32,33 as well.

Figure 6:
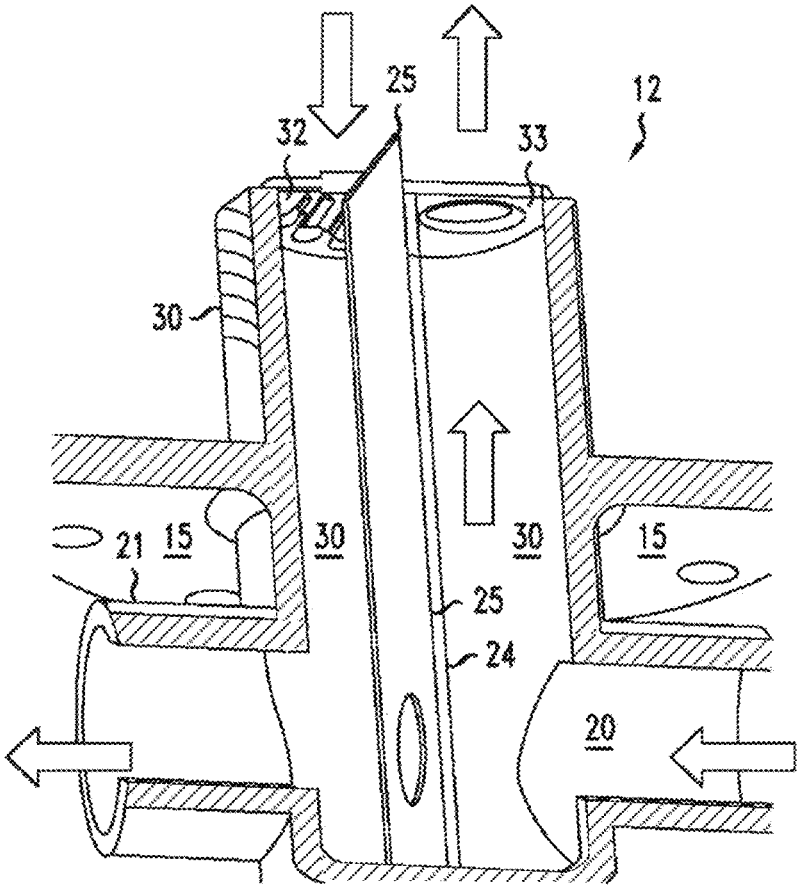
FIG. 6 depicts a further magnified, sectioned view of the tank manifold 12, where the baffle plate is replaceable.

By way of further example only, as shown in FIG. 6, the baffle plate 12 can be removable through a sealable slot 43 in the lower end surface of the manifold head 12, and replaced with a baffle plate having different total size opening(s), or removing both the vertical baffle plate as well as the horizontal cross plate 32,33. This would allow for the more precise control of the continuing flow through the expansion tank 40.

Figure 7:
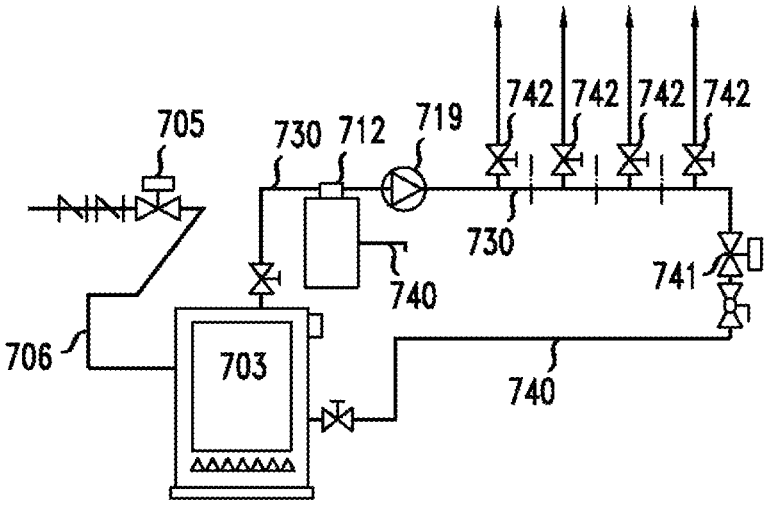
FIG. 7 is one example of a potable water system for a multiple unit building showing the manifolded tank of this invention coming off from the main hot water tank, or alternatively directly from a water source, and returning to, e,g, the hot water tank, providing a recirculating system, including for example, when no hot water is being used in the building.
Figure 8:
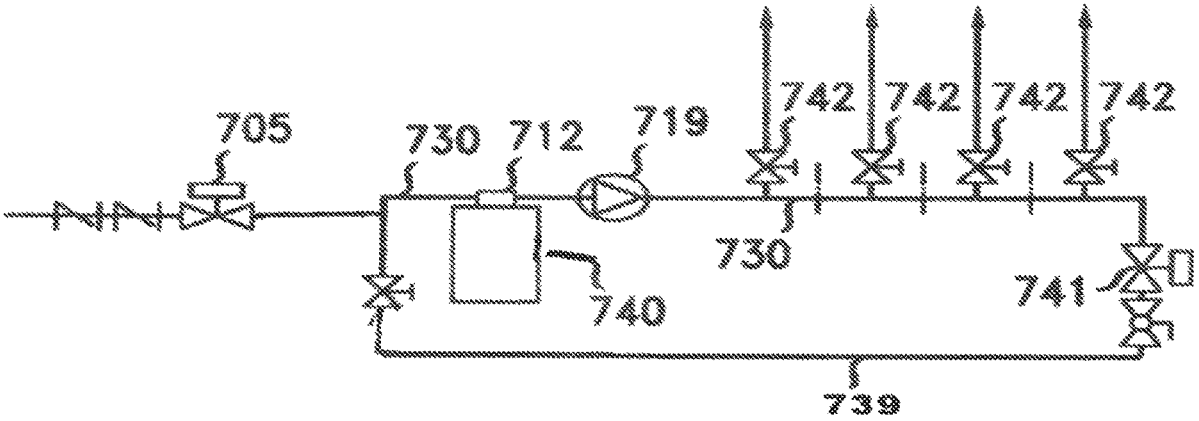
FIG. 8 depicts the cold potable water recirculation system, as the equivalent of the hot water system of FIG. 7, but without the hot water tank 703 This FIG. 8 recirculation system can operate in parallel to the hot water system of FIG. 7.

Alternatively, the baffle plate can include a either series of movable covers over the baffle opening 25, that can vary the total size of the opening(s) 25, or a single rotatable disk, rotatably secured to the baffle plate, having different size openings to vary the flow going directly past the baffle plate and out the outlet line 21 of the manifolded head 12, 712 (FIGS. 4, 7, and 8).

The total areas of each of the openings in the lower horizontal plates 32, 33, should be at least sufficient to pass the diverted flow by the baffle plate, i.e., the complementary flow to the direct through flow through the opening in the baffle plate 25.

The manifold-headed expansion tank of the present invention has preferred uses in circulation systems of potable water, both cool and heated. FIGS. 7 and 8 show two different potable water systems utilizing the manifold-headed expansion tanks of the present invention. The system shown in FIG. 7 is a system for heating the potable water, by way of example only, the heated potable water being heated in a central hot water tank 703 and then distributed through headers 742 to different users in each zone of a building, controlled by zone valves 742.

The potable water is fed to a hot water tank 703 from a source of potable water; this can include underground well or surface reservoirs, or other sources; the heated water then passes from the hot water tank 703 into a supply header 730 and distributed to the ultimate users through valved lines 742. Placed between the hot water tank and the individual user lines 742 is a manifold-headed expansion tank of the present invention where the water is treated to prevent any growth of disease-causing bacteria, such as *Legionella*. The remaining water is recirculated back to the hot water tank, in this example, before being heated and replenished by fresh potable water from the source line 701.

In these examples the source supplies potable water and the manifolded head of this invention serves to prevent the accumulation and growth of any remaining bacteria in the expansion tank and thus prevents the increase in disease-causing bacteria in the expansion tank. This is especially important during those times when there is no use of water in any of the user lines 742; the potable water continues to recirculate within the system but a sensor in the far end of line 730 sends a signal to inlet valve 705 to stop all incoming water until usage begins.

A similar type of cold potable water recirculating system will bypass the hot water tank 703, and connect line 730 directly to the incoming potable water line 706. As shown in FIG. 7, the incoming potable water, whether heated or cold, is pulled through the manifold head 712 and the expansion tank 740 by pump 719; the potable water can then flow through to the individual users through lines 742. Any unused potable water is recirculated back to line 730, either directly or by way of the hot water tank 703. In this way any solids coming from the water source, that may include any infectious bacteria, are not allowed to settle in the expansion tank and thus prevented from growing in the tank until it becomes sufficient to create the infection in anyone ingesting the bacteria-infused water among the users along lines 742.

The system as designed may also include other means to limit bacteria growth such as the addition of silver salts into the water to a sufficient concentration of the silver salts, or other bactericides, to help lower risk of infection. By avoiding static flow situations, the manifold head of the present invention helps to further prevent infections from the growth of bacteria, such as that causing Legionnaires disease.

By including the manifold headed expansion tank of this invention in the flow system, to avoid static flow areas in the expansion tank or other parts of the system, a continuing flow helps to further limit the growth of such infectious bacteria in the system.

What may be claimed is as follows:

1. A manifolded flow head for avoiding undesirable static flow in an expansion tank, the manifolded flow head comprising:

a body configured to be removably coupled to the expansion tank, the body including:

a central portion forming a central cavity;

an internal outlet configured to provide continuous fluid communication with an internal volume of the expansion tank and configured to allow continuous fluid flow from the central cavity into the expansion tank;

an external inlet configured to allow fluid flow into the central cavity;

an external outlet configured to allow fluid flow out from the central cavity;

an internal inlet configured to provide continuous fluid communication with and allow continuous fluid flow from the internal volume of the expansion tank into the central cavity;

a baffle plate disposed within the central cavity between the external inlet and the external outlet and between the internal outlet and the internal inlet, the baffle plate forming at least one baffle plate opening therethrough and configured to simultaneously:

allow a first portion of a fluid flow into the external inlet to flow directly to the external outlet, and direct a second portion of the fluid flow to continuously pass through the internal outlet and into the internal volume of the expansion tank;

wherein a total size of the at least one baffle plate opening is variable to maintain a continuous flow through the internal volume of the expansion tank to limit accumulation of debris within the expansion tank.

2. The manifolded flow head according to claim 1, wherein the body further comprises a cross plate configured to be disposed between the central cavity of the central portion and the internal volume of the expansion tank, wherein the internal outlet and the internal inlet are each formed through the cross plate.

3. The manifolded flow head according to claim 2, wherein the baffle plate is removably disposed within the central cavity independent from the cross plate.

4. The manifolded flow head according to claim 1, wherein the central portion further comprises a slot formed so as to provide access to the central cavity, and wherein the baffle plate is removably disposed within the central portion through the slot.

5. The manifolded flow head according to claim 1, further comprising a flow pipe having a first end and a second end, the first end of the flow pipe connected to the internal outlet and extending longitudinally from the internal outlet towards an opposing end of the expansion tank, the flow pipe having at least one opening adjacent to the second end.

6. The manifolded flow head according to claim 5, wherein the at least one opening adjacent to the second end of the flow pipe comprises a plurality of openings located at longitudinally spaced intervals adjacent to and extending toward the internal outlet from the second end of the flow pipe.

7. The manifolded flow head according to claim 1, further comprising a flange configured to connect the manifolded flow head to the expansion tank.

8. A system for avoiding undesirable static fluid flow, the system comprising:

an expansion tank including an internal volume and an opening providing fluid communication into the internal volume;

a manifolded flow head removably disposed at the opening of the expansion tank, the manifolded flow head comprising:

an external inlet configured to receive a fluid flow into the manifolded flow head, an internal outlet providing continuous fluid communication from the manifolded flow head into the internal volume of the expansion tank, an internal inlet providing continuous fluid communication from the internal volume of the expansion tank into the manifolded flow head, an external outlet providing fluid communication out of the manifolded flow head; and a cross plate disposed adjacent the opening of the expansion tank, wherein the internal outlet and the internal inlet are each formed through the cross plate; and a baffle plate disposed between the external inlet and the external outlet and between the internal outlet and the internal inlet, the baffle plate forming at least one baffle plate opening therethrough and configured to simultaneously:

allow a first portion of the fluid flow to pass directly to the external outlet, and direct a second portion of the fluid flow to continuously pass through the internal outlet and into the internal volume of the expansion tank.

9. The system according to claim 8, wherein the baffle plate is removably disposed within the manifolded flow head independent from the cross plate.

10. The system according to claim 8 further comprising a flow pipe having a first end and a second end, the first end of the flow pipe connected to the internal outlet and extending longitudinally from the internal outlet towards an opposing end of the expansion tank, the flow pipe having at least one opening adjacent to the second end.

11. The system according to claim 10, wherein the at least one opening adjacent to the second end of the flow pipe comprises a plurality of openings located at longitudinally spaced intervals adjacent to and extending toward the internal outlet from the second end of the flow pipe.

12. The system according to claim 8 further comprising a flange configured to connect the manifolded flow head to the expansion tank.

13. The system according to claim 8, wherein a total size of the at least one baffle plate opening is variable to maintain a continuous flow through the internal volume of the expansion tank to limit accumulation of debris within the expansion tank.

14. A manifolded flow head for avoiding undesirable static flow in an expansion tank, the manifolded flow head comprising:

a body configured to be removably coupled to the expansion tank, the body including:

a central portion forming a central cavity;

an internal outlet configured to provide continuous fluid communication with an internal volume of the expansion tank and configured to allow continuous fluid flow from the central cavity into the expansion tank;

an external inlet configured to allow fluid flow into the central cavity;

an external outlet configured to allow fluid flow out from the central cavity;

an internal inlet configured to provide continuous fluid communication with and allow continuous fluid flow from the internal volume of the expansion tank into the central cavity; and a slot formed in the body providing access to the central cavity; and a baffle plate removably disposed within the central cavity through the slot, the baffle plate being disposed between the external inlet and the external outlet and between the internal outlet and the internal inlet, the baffle plate forming at least one baffle plate opening therethrough and configured to simultaneously:

allow a first portion of a fluid flow into the external inlet to flow directly to the external outlet, and direct a second portion of the fluid flow to continuously pass through the internal outlet and into the internal volume of the expansion tank.

15. The manifolded flow head according to claim 14, wherein the body further comprises a cross plate configured to be disposed between the central cavity of the central portion and the internal volume of the expansion tank, wherein the internal outlet and the internal inlet are each formed through the cross plate.

16. The manifolded flow head according to claim 15, wherein the baffle plate is removably disposed within the central cavity independent from the cross plate.

17. The manifolded flow head according to claim 14, wherein a total size of the at least one baffle plate opening is variable to maintain a continuous flow through the internal volume of the expansion tank to limit accumulation of debris within the expansion tank.

18. The manifolded flow head according to claim 14, further comprising a flow pipe having a first end and a second end, the first end of the flow pipe connected to the internal outlet and extending longitudinally from the internal outlet towards an opposing end of the expansion tank, the flow pipe having at least one opening adjacent to the second end.

19. The manifolded flow head according to claim 18, wherein the at least one opening adjacent to the second end of the flow pipe comprises a plurality of openings located at longitudinally spaced intervals adjacent to and extending toward the internal outlet from the second end of the flow pipe.

20. The manifolded flow head according to claim 14, further comprising a flange configured to connect the manifolded flow head to the expansion tank.

* * * * *